US005524442A

United States Patent [19]

Bergman, Jr. et al.

[11] Patent Number: 5,524,442

[45] Date of Patent: Jun. 11, 1996

[54] COOLING SYSTEM EMPLOYING A PRIMARY, HIGH PRESSURE CLOSED REFRIGERATION LOOP AND A SECONDARY REFRIGERATION LOOP

[75] Inventors: Thomas J. Bergman, Jr., Clarence Center; Mark J. Roberts, Grand Island; Arun Acharya, East Amherst; Carl J. Heim; Alfred M. Czikk, both of Amherst, all of N.Y.

[73] Assignee: Praxair Technology, Inc., Danbury, Conn.

[21] Appl. No.: 265,871

[22] Filed: Jun. 27, 1994

[51] Int. Cl.[6] ..... F25B 9/06

[52] U.S. Cl. ..... 62/86; 62/401; 62/434

[58] Field of Search ..... 62/86, 87, 401, 62/434

[56] References Cited

U.S. PATENT DOCUMENTS

| | | | |
|---|---|---|---|
| 2,779,171 | 1/1957 | Lindenblad | 62/434 X |
| 3,144,316 | 8/1964 | Koehn et al. | 62/9 |
| 3,156,101 | 11/1964 | McGuffey | 62/434 X |
| 3,196,631 | 7/1965 | Holland | 62/87 X |
| 3,199,304 | 8/1965 | Zeitz et al. | 62/86 X |
| 3,247,678 | 4/1966 | Mohlman | 62/434 X |
| 3,677,019 | 7/1972 | Olszewski | 62/9 |
| 3,696,637 | 10/1972 | Ness et al. | 62/402 |
| 3,868,827 | 3/1975 | Linhardt et al. | 62/63 |
| 4,315,409 | 2/1982 | Prentice et al. | 62/63 |
| 4,317,665 | 3/1982 | Prentice | 62/63 |
| 4,730,464 | 3/1988 | Lotz | 62/401 |
| 4,778,497 | 10/1988 | Hanson et al. | 62/11 |
| 5,267,449 | 12/1993 | Klezek et al. | 62/86 |

*Primary Examiner*—William E. Tapolcai
*Attorney, Agent, or Firm*—Stanley Ktorides

[57] ABSTRACT

A cooling system includes a unit for processing product to be cooled or frozen. A secondary refrigeration loop is connected to this unit and introduces a refrigerant at or near atmospheric pressure into the unit. The secondary refrigeration loop may be open or closed. The secondary loop includes a secondary heat exchanger for cooling the refrigerant. A primary, closed refrigeration loop, operating at a pressure of not less than 2 atmospheres, includes a forward flow path which comprises a primary refrigerant compressor for producing compressed primary refrigerant, a primary heat exchanger for receiving and cooling the compressed primary refrigerant and an expander for further cooling and transferring the compressed refrigerant to the secondary heat exchanger to enable cooling of the secondary refrigerant. The primary loop further includes a return flow path from the secondary heat exchanger to the primary refrigerant compressor and to the primary heat exchanger. The primary heat exchanger thereby provides heat exchange from the return flow path to the forward flow path to accomplish a cooling action.

18 Claims, 2 Drawing Sheets

COOLING SYSTEM EMPLOYING A PRIMARY, HIGH PRESSURE CLOSED REFRIGERATION LOOP AND A SECONDARY REFRIGERATION LOOP

FIELD OF THE INVENTION

This invention relates to a system for delivering low temperature refrigeration and, more particularly, to a cooling system that employs primary and secondary refrigeration loops.

BACKGROUND OF THE INVENTION

In the food freezing industry, high food quality with low dehydration losses is obtained using low temperature liquid nitrogen freezing systems which operate at about –320° F. Ammonia and freon vapor compression mechanical systems, which operate at relatively high temperatures, such as –40° F., are commonly used to freeze food in an economical manner, but with high freezing times and high dehydration losses. Recently, high performance vapor compression, mechanical systems have emerged which produce high quality frozen foods with low dehydration losses at relatively high temperatures of from –40° F. to –60° F. Because they operate at such relatively high temperatures, dehydration losses associated with high performance mechanical freezers leave room for improvement. They typically also cannot operate at low temperatures due to limitations associated with common refrigerants. If a low temperature refrigerant system could be developed, dehydration losses can be appreciably reduced.

Direct contact reverse Brayton cycle, cold air refrigeration systems have been developed recently which operate at lower temperatures than mechanical systems. These systems cool food by generating cold air which directly impinges upon the food at high velocities. Cold air is created by compression/expansion and is then injected into the freezer. Air leaving the freezer is filtered to remove gross particulates and its refrigeration is recovered in a heat exchanger. The warmed air stream is then either vented or recycled back to the compressor, e.g. see U.S. Pat. No. 5,267,449 to Klezek, et al. Such systems are competitive with liquid nitrogen systems, based on operating cost, because they produce refrigeration at higher temperatures. However, their operating costs are higher than those associated with high performance mechanical freezers, even if improved dehydration losses are included in the analysis.

Power requirements associated with direct contact, reverse Brayton cycle refrigeration systems are high relative to mechanical systems for several reasons. At low air circulation rates, the air temperature rise across the freezer must be high to deliver sufficient refrigeration to cool the product. Because the freezer operates at atmospheric pressure, the pressure ratio across the compressor and turbine must therefore be large. As a result, power requirements are high. At high air circulation rates, the air temperature rise through the freezer is small and the pressure ratio across the compressor and turbine is small. However, since the freezer operates at atmospheric pressure, any pressure losses observed across, for example, filters and prepurifiers become significant relative to the operating pressure. Therefore, the power required is also high. A minimum power requirement exists where the combination of these two driving forces is minimized. This minimum is typically large relative to the power required for mechanical systems.

Several patents describe direct contact refrigeration systems wherein a refrigeration gas passes in direct contact with the product being frozen and is then recirculated, compressed, expanded and reused. Because those prior art systems are direct contact and apply the refrigerating gas at atmospheric pressure, filters, dehydrators, etc. are required in the return flow path to assure that entrained particulate matter and water do not cause undue deterioration of the refrigeration equipment. Such open loop systems can be found in the above noted Klezek et al. U.S. Pat. No. 5,267,449 and in the following U.S. Pat. Nos. 3,696,637 to Ness et al.; 3,868,827 to Linhardt et al.; 4,315,409 to Prentice et al.; 4,317,665 to Prentice; and 4,730,464 to Lotz.

Closed loop refrigeration systems have also been widely employed. Closed loop refrigeration systems operate with a primary refrigerant, generally at high pressure which is maintained in a closed path, with heat transfer being accomplished through a heat exchanger. For instance, such closed loop systems have been employed in gas liquefaction processes wherein the gas being liquefied takes one path through a heat exchanger and the primary refrigerant takes another independent path through the heat exchanger. Such systems are shown in U.S. Pat. Nos. 3,677,019 to Olszewski; 3,144,316 to Koehn et al.; and 4,778,497 to Hanson et al.

U.S. Pat. No. 3,696,637 to Ness et al. discloses apparatus for producing refrigeration that employs multiple stages of primary refrigerant compression and two stages of refrigerant work expansion in which the horsepower developed by the work expansion stages is utilized to drive the final stage of refrigerant compression.

It is an object of this invention to provide an improved refrigeration system which avoids subjecting a refrigerant gas that contacts a product being cooled to subsequent compression and expansion in a refrigeration cycle.

It is still another object of this invention to provide an improved refrigeration system wherein a principal refrigeration generation loop operates at high pressure, thereby lowering required power and enabling provision of smaller mass refrigeration components.

SUMMARY OF THE INVENTION

The cooling system includes a unit for processing product to be cooled or frozen. A secondary refrigeration loop is connected to this unit and introduces a secondary refrigerant at or near atmospheric pressure into the unit. The secondary refrigeration loop may be open or closed. The secondary loop includes a secondary heat exchanger for cooling the secondary refrigerant. A primary, closed refrigeration loop, operating at a pressure of not less than 2 atmospheres, includes a forward flow path which comprises a primary refrigerant compressor for producing compressed primary refrigerant, a primary heat exchanger for receiving and cooling the compressed primary refrigerant and, an expander for further cooling and transferring the compressed primary refrigerant to the secondary heat exchanger to enable cooling of the secondary refrigerant. The primary loop further includes a return flow path from the secondary heat exchanger to the primary heat exchanger, to the primary refrigerant compressor, to the primary heat exchanger and then to the expander. The primary heat exchanger thereby provides heat exchange from the return flow path to the forward flow path to accomplish a cooling action.

DETAILED DESCRIPTION OF THE INVENTION

As will become apparent below, the invention enables the cooling or freezing of food or other product by generating and delivering refrigeration in two separate streams. Refrigeration is generated in a primary closed-loop compression/expansion cycle. Air, which is preferably used as the refrigerant, is compressed, cooled and expanded to a low temperature. It then passes through a heat exchanger, located either within or outside a freezer compartment, where it cools a secondary refrigerant stream present in a secondary refrigeration loop. The secondary refrigerant may be a gas, a liquid, or a solid particulate. The secondary cooled air stream delivers refrigeration to the product that is located in the freezer. The primary closed loop allows the refrigeration to be generated at high pressures, but with small pressure ratios across internal compressors and expansion turbines. Since the primary closed loop operates at high pressure, pressure losses do not contribute significantly to power requirements. Because the pressure ratios are small, losses are low and the power required for compression is relatively small. The heat exchange fluid contained in the secondary open loop stream, preferably cools or freezes the solid or liquid product by direct impinging contact.

The refrigeration system of the invention hereof utilizes a reverse Brayton cycle which operates at a temperature preferably less than −60° F. Significant improvement in dehydration losses are thus achieved in frozen food products. The invention has been found to be optimal in minimizing both dehydration losses and required power when the freezer is operated at an air temperature of approximately −90° F.

Figures 1, 2:
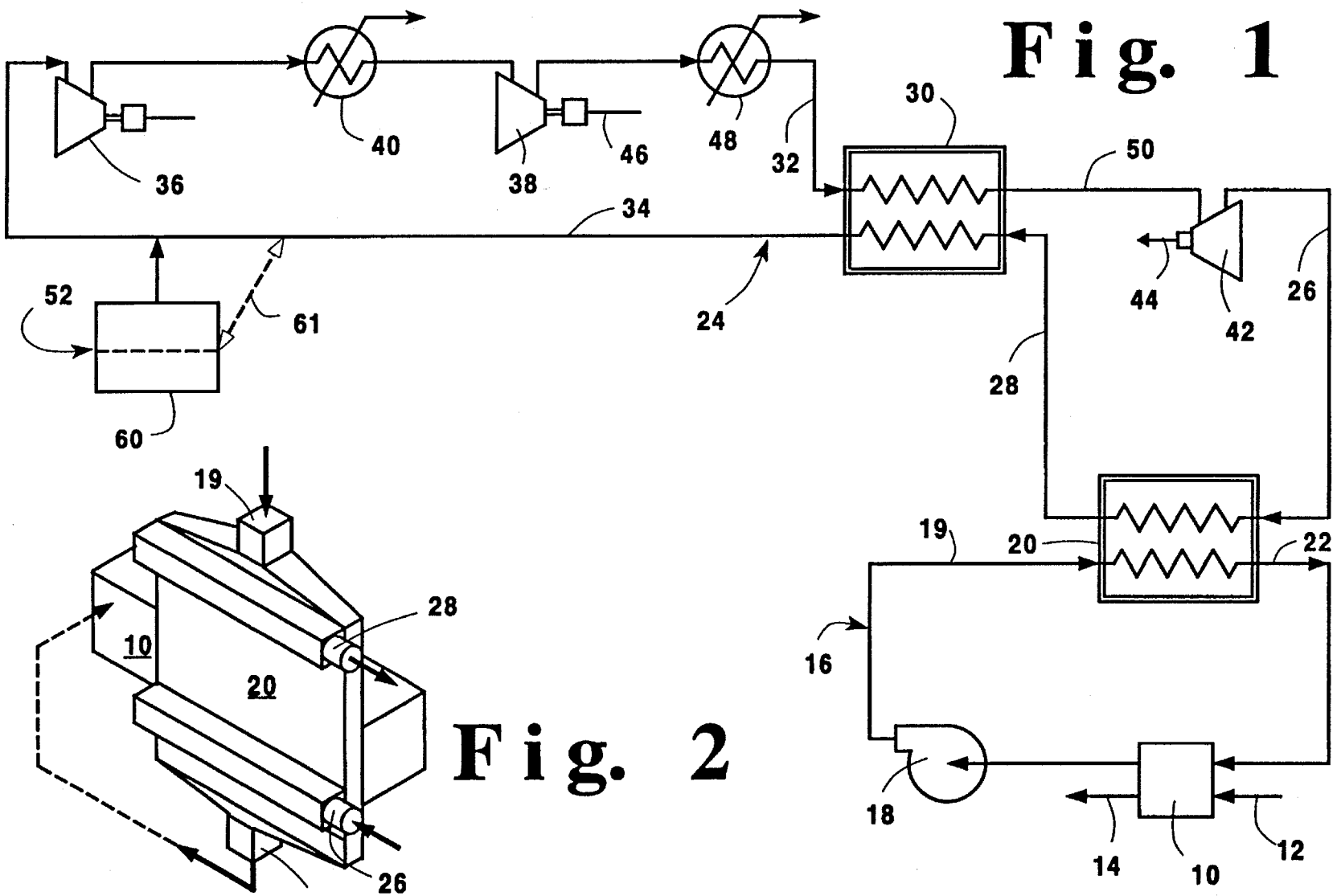
FIG. 1 is a schematic diagram of a refrigeration system incorporating an embodiment of the invention hereof.
FIG. 2 is a perspective view of a preferred heat exchanger and a freezer compartment employed in the system of FIG. 1.

Referring now to FIG. 1, a description of a refrigeration system that incorporates a preferred embodiment of the method of the invention will be presented. The description assumes, for purpose of example only, that the refrigeration system shown in FIG. 1 cools a food product stream having an inlet temperature at the freezer of 32° F. and producing a frozen product stream having a temperature of 0° F. A freezer compartment 10 has an inlet product flow 12 at 32° F. and an outlet product flow 14 at 0° F. Refrigeration air injected into freezer 10 directly impinges upon the product within freezer compartment 10 to accomplish the freezing action. An optimal freezing temperature of −90° F. is applied by assuring an inlet temperature to the freezer of −100° F. and an outlet temperature of −90° F.

A secondary cooling loop 16 comprises a blower 18 which feeds outlet air from freezer compartment 10 via conduit 19 to a secondary heat exchanger 20 and from there, via a conduit 22, back to freezer compartment 10. To produce the required product temperature differential of −32° F., a significant amount of heat must be removed from the product. The pressure of the air entering freezer compartment 10 is generally atmospheric, but may be within a range of 1 to 2 atmospheres. The secondary refrigerant flowing through cooling loop 16 may not all pass through secondary heat exchanger 20.

Refrigeration to cool the circulating air stream in secondary loop 16 is generated in a high pressure primary closed refrigeration loop 24 that includes secondary heat exchanger 20. Preferably air is employed as the refrigerant in primary closed loop 24. The air enters secondary heat exchanger 20 via conduit 26 at, for example, a temperature and pressure of −100° F. and 148 pounds per square inch (psia), respectively. That refrigerant flow is warmed against the low pressure circulating air stream within secondary open loop 16 and exits from secondary heat exchanger 20 into conduit 28 at approximately −95° F. The refrigerant then enters into a primary heat exchanger 30 where it is warmed against a feed refrigerant stream which enters primary heat exchanger 30 via conduit 32. As the refrigeration air exits from primary heat exchanger 30 into conduit 34, it evidences a temperature of approximately 68° F. at 148 psia. In another embodiment the freezer may be integral with the secondary heat exchanger rather than separate from it as illustrated in FIG. 1.

The refrigerant air stream is then compressed in a two stage compressor system comprising compressors 36 and 38. In compressor 36, the refrigerant air stream is compressed to 166 psia, from 148 psia. At the exit of compressor 36, the compressed air stream has a temperature of +87° F. The compressed air stream is cooled in an intercooler 40 (using chilled water) to approximately 70° F. and is fed to compressor 38. The refrigerant air stream is compressed to 180 psia in compressor 38. Compressor 38 is mechanically coupled to a downstream turbine/expander 42. The mechanical coupling is schematically shown via lines 44 and 46. The power requirements of compressors 36 and 38 may be adjusted so that compressor 36 can be directly driven by a downstream turbine/expander 42. More specifically, the work available from the expansion occurring in turbine/expander 42 enables a direct coupling thereto of compressor 38.

When the compressed air stream leaves compressor 38, it is at a high pressure of 180 psia and at a temperature of 87° F. That air stream is cooled in intercooler 48 to produce an air stream in conduit 32 whose temperature is 70° F. The compressed air stream then passes through primary heat exchanger 30 and is cooled against the returning air flow entering via conduit 28. As a result, the refrigerant air exiting primary heat exchanger 30, via conduit 50, is at a temperature of −92° F. The compressed refrigerated air stream is then expanded in turbine/exander 42 and, as aforestated, produces sufficient work to directly power compressor 38. The expanded air stream leaving turbine/expander 42 has a temperature and pressure of −110° F. and 148 psia, respectively, and is fed via conduit 26 to secondary heat exchanger 20. Thus the air stream is expanded to a pressure about 82% of the high pressure; this is a pressure ratio of only 1.2, i.e., 180/148.

To provide for gas lost in the high pressure gaseous refrigeration system, a source of make-up gas 52 is coupled to loop 24 and includes a purifier 60 that is thermally linked to loop 24, as illustrated symbolically by line 61, to enhance its purification action.

Secondary heat exchanger 20 is designed so that plugging by entrained particulate matter and/or snow created by the freezing of moisture which is carried along with the refrigerated air, is prevented. To avoid such a plugging problem, preferably secondary heat exchanger 20 includes straight heat exchange passages and employs a refrigerated air velocity within the range of from 10 to 30 feet per second. This combination effectively prevents plugging within heat exchanger 20 that might occur were lower air velocities and curved air passages employed.

In FIG. 2, heat exchanger 20 is juxtaposed to freezer compartment 10. Refrigerated air is received via conduit 19 into secondary heat exchanger 20 and exits therefrom via conduit 22. From there, it is fed into freezer compartment 10 and then, after impingement upon the product being cooled or frozen, to blower 18. Compressed refrigerant from primary refrigeration loop 24 is inlet at conduit 26 and is taken out of secondary heat exchanger 20 via conduit 28.

Figure 3:
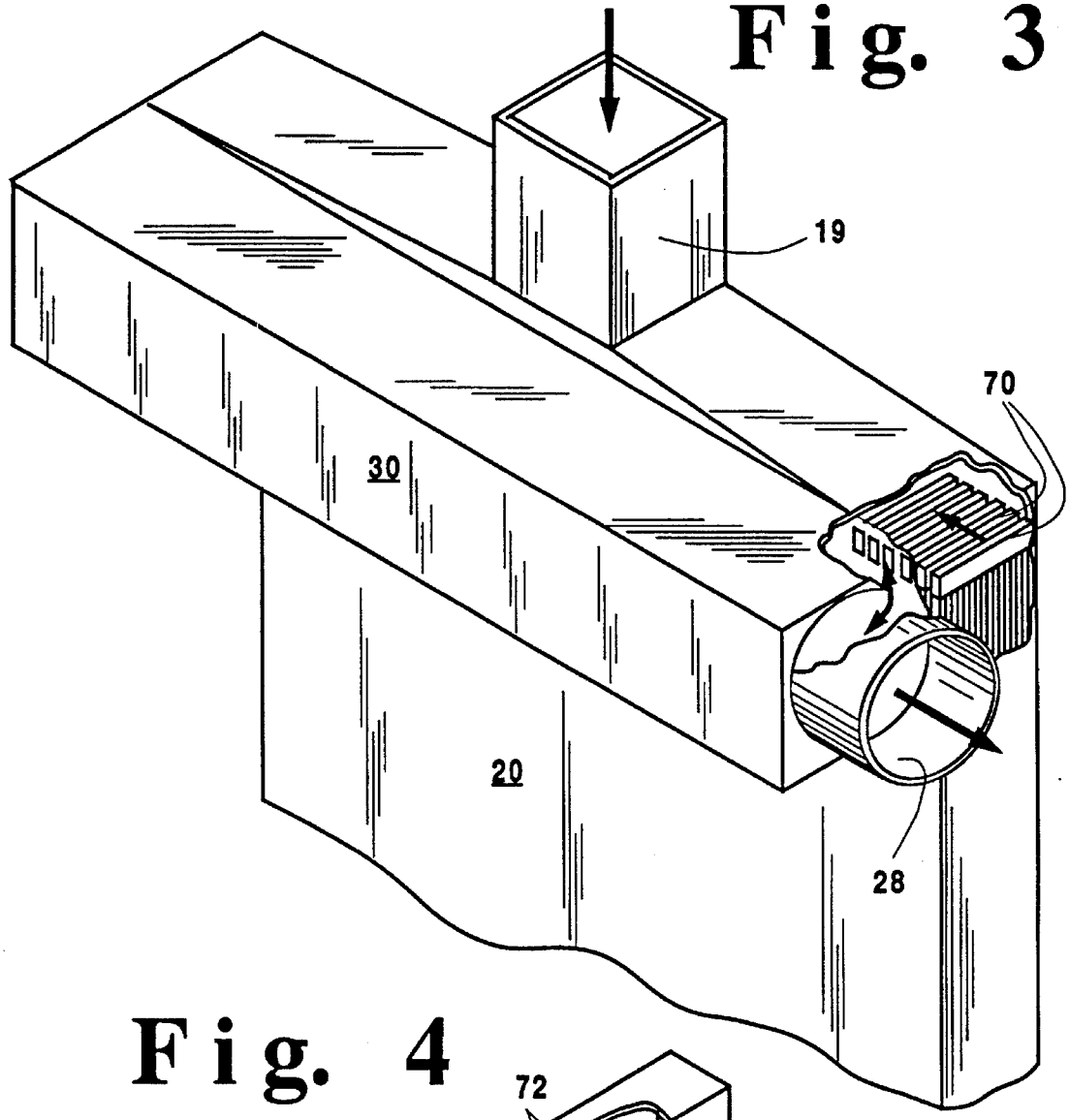
FIG. 3 is a perspective view of a portion of the heat exchanger shown in FIG. 2.
Figure 4:
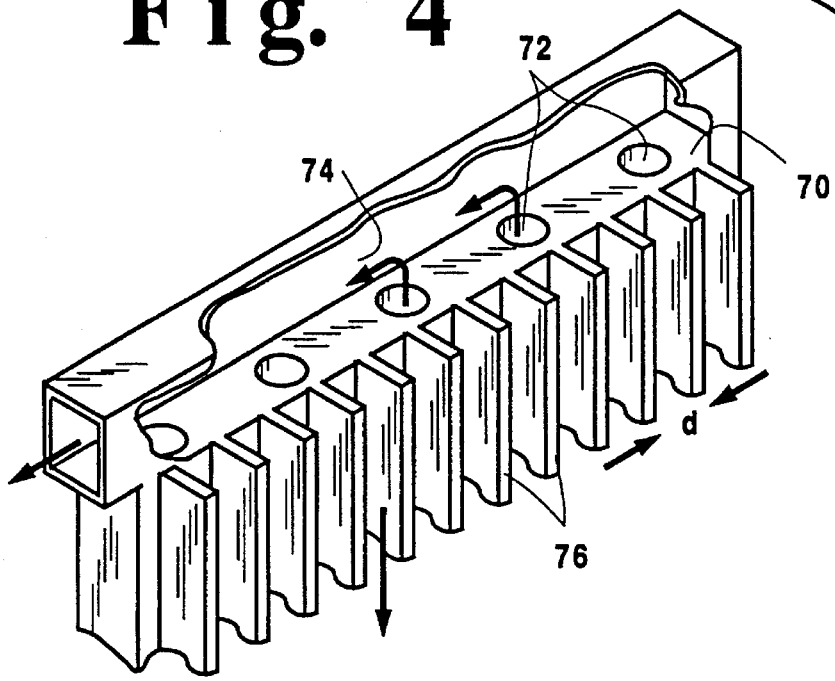
FIG. 4 is a perspective view of a portion of the internal heat exchange structure of the heat exchanger of FIG. 2. The numerals in the Figures are the same for the common elements.

An expanded view of the uppermost portion of secondary heat exchanger 20 is shown in FIG. 3 and illustrates the position of a high pressure manifold 30 which feeds output conduit 28 with the compressed refrigerant after it has passed through secondary heat exchanger 20. In FIGS. 3 and 4, portions of secondary heat exchanger 20 and heat transfer structure 70 have been broken away to enable a visualization of their internal organization. A plurality of heat transfer structures 70 are positioned within the air flow path secondary heat exchanger 20 and include passages that enable travel therethrough of the compressed refrigerant.

An expanded view of the uppermost portion of a heat transfer structure 70 is shown in FIG. 4 and includes a plurality of vertical channels 72 through which compressed refrigerant passes into a small manifold 74 and from there into manifold 30. Linear air passages created by fins 76 receive the refrigerant air from conduit 19 and enable the cooling thereof via the action of the compressed refrigerant of heat transfer structure 70. The distance "d" between the innermost portions of fins 76 is approximately from 0.1 to 0.5 inches and is preferably approximately 0.3 inches.

Secondary heat exchanger 20, constructed as shown in FIGS. 2–4, thus achieves an efficient heat transfer action while, at the same time, preventing the accumulation of either snow and/or particulate matter within the air flow channels. The high velocity of the refrigerant air through the heat transfer channels, and their linear arrangement, presents little opportunity for the accumulation of material that might cause a blockage. Secondary heat exchanger 20 may also, for example, be of a compact, finned tube type located within freezer 10, so that circulating refrigerant can be used to cool or freeze the product.

It is to be noted in the above example, that the pressure differential within primary closed loop 24 is less than 20%. That is, the pressure of expanded stream in conduit 26 is greater than 80% of the pressure of the compressed stream in conduit 50. Generally the pressure of the expanded stream is within a range of from 30% to 90% of the compressed stream. A more preferred range is from 40% to 90% and a most preferred range is 50% to 80%. Furthermore, by operating primary refrigeration loop 24 at a high pressure with only a small pressure reduction during the expansion, highly dense fluid flow is accomplished, enabling the use of physically smaller components throughout the entire loop. The refrigerant present in primary loop 24 never touches the product being refrigerated, thereby preventing contamination and eliminating the need for dehydrators and filters in primary loop 24. Secondary refrigeration loop 16 operates at atmospheric pressure and may employ a filter, if required, by the characteristics of the product being frozen.

While the invention has been described in the context of a specific example, it is to be understood that the refrigerant employed in primary loop 24 need not be air, but any other appropriate refrigerant that is operable at high pressure such as nitrogen, argon, helium, carbon dioxide and gas mixtures thereof. Further, while the preferred refrigerant in secondary loop 16 is air, other gases, such as those useful in primary loop 24, may be employed. The pressure within primary refrigeration loop 24 should not be less than 2 atmospheres and is preferably within the range of from 100 to 200 psia.

As one skilled in the art will understand, the employment of a high pressure primary refrigeration loop of necessity requires that some available refrigeration capacity be sacrificed as the refrigerant gas is not fully expanded to the lowest available pressure, e.g. atmospheric pressure. However, by maintaining high pressure high within primary refrigeration loop 24, the power required to generate refrigeration is reduced and the volumetric flow is lessened, thereby reducing the power and size required of equipment for handling refrigerant flow as compared to that which would be required were lower pressures employed. Reduced volumetric flow also results in reduced pressure drops through conduits and components so that the bulk of compression is used for producing refrigeration through gas expansion.

In summary, the primary closed refrigeration loop, contrary to what would generally be considered advantageous, operates at high pressure which not only helps to reduce the pressure drop through the various components of the loop but also helps to reduce the size of the conduits and other components due to the reduced volumetric flow of the compressed refrigerant. The other very important and distinguishing aspect of the primary refrigeration loop design of this invention is the relatively low pressure ratios involved in the refrigerant expansion. Normal practice is to fully expand a compressed refrigerant to maximize the refrigeration produced and to achieve lower temperature refrigeration. This requires the expansion of the compressed refrigerant, in general, to at least about one atmosphere. In some cases, expansion to even subatmospheric pressure levels is practiced to further increase the refrigeration produced. The conventional practice thus maximizes the achievable refrigeration using the available major components of the loop, e.g., expanders which typically operate at a pressure ratio from 3 to 8. Contrary to such practice, the primary loop of this invention has a preferred low pressure in the range of 100 psia, versus about 1 atmosphere in conventional practice and a pressure ratio generally less than 3 and preferably less than 2. This unique combination of low pressure ratio and high low-pressure level provides the needed refrigeration without high volumetric flows. It also lends itself to the exact refrigeration level desired for product cooling or freezing.

Potential applications of the described refrigeration system include cooling and/or freezing of food products, cryogrinding of tires, freeze drying applications in the pharmaceutical industry and heat removal in chemical processes such as crystallization and gas condensation.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A refrigeration system, comprising:

a secondary refrigeration loop connected to a refrigeration load for introducing a secondary loop refrigerant into said refrigeration load, and including secondary heat exchange means for cooling said secondary loop refrigerant; and a primary closed refrigeration loop including a forward flow path comprising refrigerant at a high pressure, expansion means for expanding said primary loop refrigerant to a pressure not less than two atmospheres and within the range of from 40% to 90% of said high pressure so as to cool said primary loop refrigerant and for further transferring said primary loop refrigerant that has been expanded to said secondary heat exchange means to enable said cooling of said secondary loop refrigerant, said primary loop refrigerant thereafter fed via a return flow path to a refrigerant compressor means.

2. The refrigeration system as recited in claim 1, wherein said primary closed refrigeration loop further comprises:

primary heat exchange means for receiving and cooling compressed primary loop refrigerant from said refrigerant compressor means in said forward flow path and for receiving primary loop refrigerant from said secondary heat exchange means and providing a heat exchange from said return flow path to said forward flow path.

3. The refrigeration system as recited in claim 1 wherein said expansion means expands said compressed primary loop refrigerant to a pressure within the range of from 50% to 80% of said high pressure.

4. The refrigeration system of claim 1, wherein said secondary loop refrigerant directly impinges on a product being cooled or frozen.

5. The refrigeration system of claim 1, wherein said compressor means comprises first and second compressors and said expansion means comprises a rotary expander, power requirements of said second compressor sized to enable a direct mechanical coupling between said second compressor and said rotary expander.

6. The refrigeration system as recited in claim 1 wherein said primary loop refrigerant is air.

7. The refrigeration system of claim 1 wherein said primary loop refrigerant is cooled to a temperature of less than −60° F.

8. The refrigeration system of claim 1, wherein said primary closed refrigeration loop is maintained at a pressure in excess of 100 psia.

9. The refrigeration system of claim 1, wherein said secondary heat exchange means comprises a heat exchange structure having a straight line flow path from inlet to outlet of the heat exchange structure, for said refrigerant.

10. The refrigeration system of claim 9, wherein blower means are coupled to the inlet of said secondary heat exchange means providing a refrigerated gas flow rate within the range of from 10 to 30 feet per second, so as to prevent plugging of heat exchange passages by particulate matter or snow created by frozen moisture.

11. The refrigeration system of claim 10, wherein heat exchange surfaces in said secondary heat exchange means are separated by a distance in a range of from 0.1 to 0.5 inch.

12. The refrigeration system of claim 1, wherein said compressed primary loop refrigerant is selected from a group consisting of air and other gas mixtures that exhibit suitable thermodynamic properties to act as compressed refrigerants.

13. The refrigeration system of claim 1, wherein said primary closed refrigeration loop further includes a source of make-up refrigerant which includes a purifier, said purifier thermally linked to said primary closed refrigeration loop.

14. The refrigeration system of claim 1, wherein said refrigeration load includes a refrigeration unit for holding product to be cooled or frozen.

15. A refrigeration method comprising the steps of:

introducing a secondary loop refrigerant into a refrigeration load, said secondary loop refrigerant contained in a secondary refrigeration loop which includes secondary heat exchange means for cooling the secondary loop refrigerant;

compressing a primary loop refrigerant to a high pressure through refrigerant compressor means included in a primary closed refrigeration loop that includes a forward flow path comprising the refrigerant compressor means and expansion means;

expanding said primary loop refrigerant to a pressure not less than two atmospheres and within the range of from 40% to 90% of said high pressure so as to cool said primary loop refrigerant;

passing said primary loop refrigerant that has been expanded to said secondary heat exchange means to enable cooling of said secondary loop refrigerant; and feeding said primary loop refrigerant thereafter via a return flow path to said refrigerant compressor means.

16. The refrigeration method of claim 15 wherein said primary loop refrigerant is cooled to a temperature of less than −60° F.

17. The refrigeration method of claim 16, wherein said primary closed refrigeration loop is maintained at a pressure in excess of 100 psia.

18. The refrigeration method of claim 15, wherein said secondary loop refrigerant directly impinges on a product being cooled or frozen.

* * * * *